US006415446B1

(12) United States Patent
McLean et al.

(10) Patent No.: US 6,415,446 B1
(45) Date of Patent: Jul. 9, 2002

(54) PROTECTIVE GLOVE

(75) Inventors: Debra Anne McLean, Northbridge; Steve Szczesuil, Framingham, both of MA (US); Gary Proulx, Harrisville, RI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/613,050

(22) Filed: Jul. 5, 2000

(51) Int. Cl.[7] ..... A41D 19/00

(52) U.S. Cl. ..... 2/161.6; 2/16; 2/161.8; 2/163

(58) Field of Search ..... 2/16, 20, 159, 2/161.1, 161.2, 161.4, 161.5, 161.6, 161.7, 161.8, 162, 163, 168, 170

(56) References Cited

U.S. PATENT DOCUMENTS

| | | | | | |
|---|---|---|---|---|---|
| 3,822,417 | A | * | 7/1974 | Lars-Jos | 2/169 |
| 4,004,295 | A | | 1/1977 | Byrnes, Sr. | 2/161 R |
| 4,224,692 | A | * | 9/1980 | Sundberg | 2/161 |
| 4,279,681 | A | | 7/1981 | Klimezky | 156/245 |
| 4,441,213 | A | | 4/1984 | Trumble et al. | 2/161 R |
| 4,654,896 | A | * | 4/1987 | Rinehart | 2/163 |
| 4,785,479 | A | * | 11/1988 | Watanabe | 2/163 |
| 5,020,159 | A | * | 6/1991 | Hellickson | 2/158 |
| 5,054,126 | A | | 10/1991 | Rivkin | 2/161 R |
| 5,437,621 | A | * | 8/1995 | Andrews et al. | 602/42 |
| 5,745,919 | A | | 5/1998 | Kraatz | 2/161.6 |
| 5,857,216 | A | * | 1/1999 | Gold | 2/169 |
| 5,907,870 | A | * | 6/1999 | Monroe et al. | 2/161.7 |
| 6,044,493 | A | * | 4/2000 | Post | 2/167 |
| 6,065,155 | A | * | 5/2000 | Sandusky | 2/161.1 |
| 6,212,914 | B1 | * | 4/2001 | Kolmes et al. | 66/172 |
| 6,219,842 | B1 | * | 4/2001 | Bachner, Jr. | 2/2.5 |

* cited by examiner

*Primary Examiner*—Peter Nerbun
*Assistant Examiner*—Katherine Moran
(74) *Attorney, Agent, or Firm*—Vincent J. Ranucci

(57) ABSTRACT

A protective glove comprising a first portion for covering the palm-side of a wearer's hand and a second portion that is attached to the first portion and which covers the back side of the wearer's hand. The first portion is comprised of a single, seamless piece of pliable plastic molded in a three-dimensional shape that conforms to the shape of a hand in a relaxed position. The second portion is comprised of a cut resistant material. The protective glove includes thumb and finger stalls. Each stall has a first side corresponding to the palm side of the wearer's hand and a second side that corresponds to the back side of the wearer's hand. Each stall is comprised of the molded, pliable plastic except for a portion of the second side of each stall which is comprised of the cut resistant material. In one embodiment, the cut resistant material is also liquid resistant.

16 Claims, 3 Drawing Sheets

PROTECTIVE GLOVE

Government for Governmental purposes without the payment of any royalty thereon.

The invention described herein may be manufactured and used by the U.S.

BACKGROUND OF THE INVENTION

1. Field of the Invention

The present invention generally relates to a protective glove.

2. Problem to be Solved

Prior art protective gloves are typically fabricated from leather. Such gloves do not have sufficient durability for handling sharp cable, barbed wire, concertina wire and razor wire. Consequently, these prior art gloves deteriorate due to abrasions, cuts, tears punctures thereby increasing the risk of injury to the wearer. In order to remedy these deficiencies, manufacturers began fabricating these gloves from relatively thick layers of leather. However, the increased thickness of the gloves caused the gloves to be relatively heavy, bulky, cumbersome and inflexible. Another disadvantage is the increase in the weight of the gloves when the gloves contact and absorb liquids, e.g. water, petroleum, lubricants, etc.

Typically, metal staples are used to assemble the aforementioned prior art leather gloves. Specifically, metal staples are inserted into the leather glove with a hand operated stapling machine so as to attach the front and back layers of the glove together and to form rows of staples throughout the front side of the glove to provide slash or cut protection. However, staples typically corrode or rust when exposed to moisture, water, chemicals, etc. Since the process for assembling the prior art gloves is basically a relatively time-consuming manual process, the per-unit cost of the prior art gloves is relatively high.

It is therefore an object of the present invention to provide a new and improved protective glove that solves the problems associated with prior art conventional gloves.

It is another object of the present invention to provide a new and improved protective glove that can be manufactured at reasonable costs.

Other objects and advantages of the present invention will be apparent to one of ordinary skill in the art in light of the ensuing description of the present invention.

SUMMARY OF THE INVENTION

The present invention is directed to a protective glove comprising a first portion for covering the palm-side of a wearer's hand and a second portion that is attached to the first portion and which covers the back side of the wearer's hand. The first portion comprises a single, seamless piece of pliable plastic molded in a three-dimensional shape that conforms to the shape of a hand in a relaxed position. The second portion is comprised of a cut resistant material. The protective glove includes thumb and finger stalls. Each stall has a first side corresponding to the palm side of the wearer's hand and a second side that corresponds to the back side of the wearer's hand. Each stall is comprised of the pliable plastic except for a portion of the second side of each stall which is comprised of the cut resistant material. In one embodiment, the cut-resistant material is also liquid resistant.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

Figure 1:
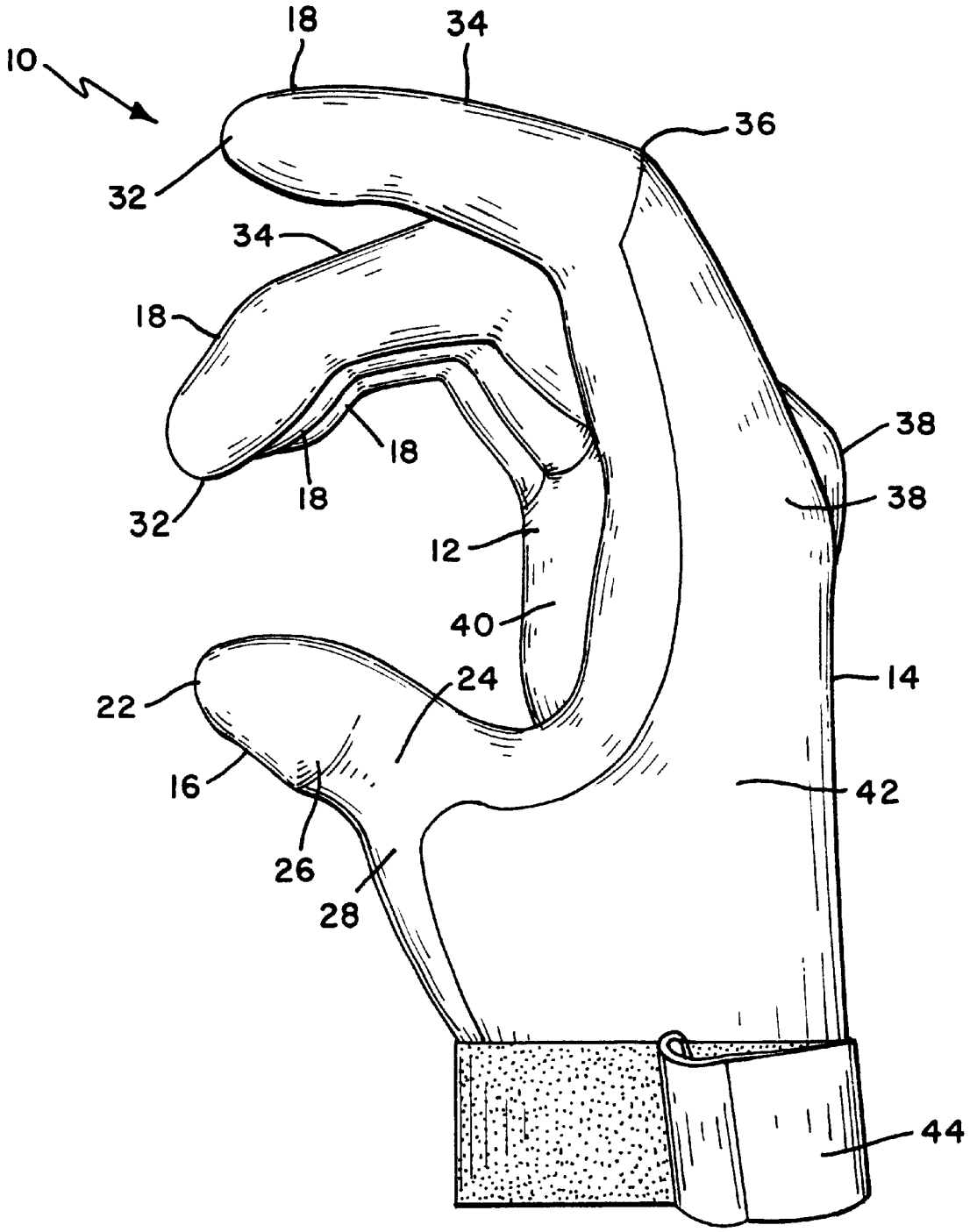
FIG. 1 is a side elevational view of the protective glove of the present invention.

Referring to FIG. 1, there is shown protective glove 10 of the present invention. Protective glove 10 comprises front side 12, back side 14, thumb stall 16 and finger stalls 18. Thumb portion 16 includes front side 20, tip portion 22, back side 24, knuckle portion 26 and base portion 28. Similarly, each finger stall 18 includes front side 30, tip portion 32, back side 34, knuckle portion 36 and base portion 38.

Figure 2:
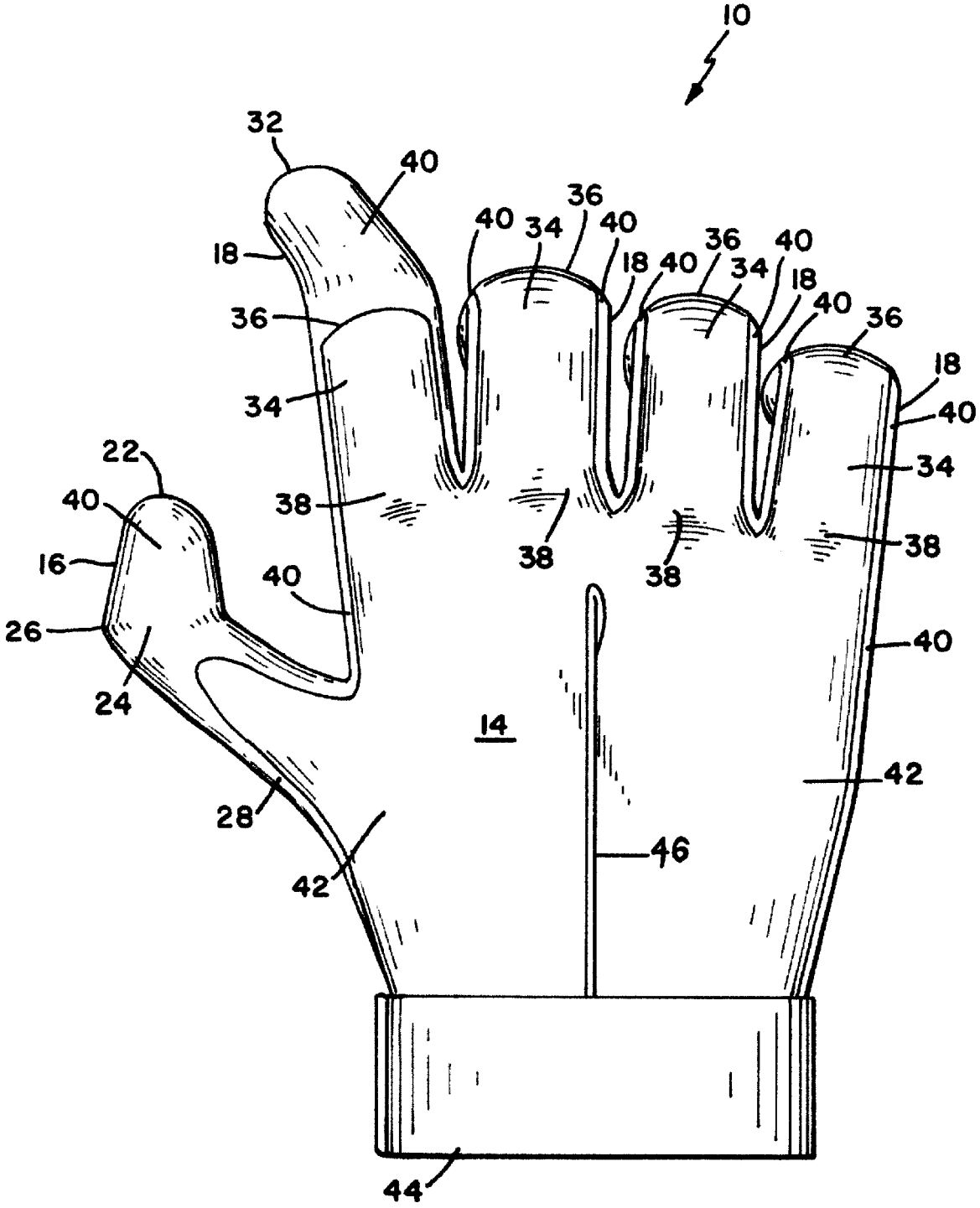
FIG. 2 is a rear elevational view of the protective glove of FIG. 1.
Figure 3:
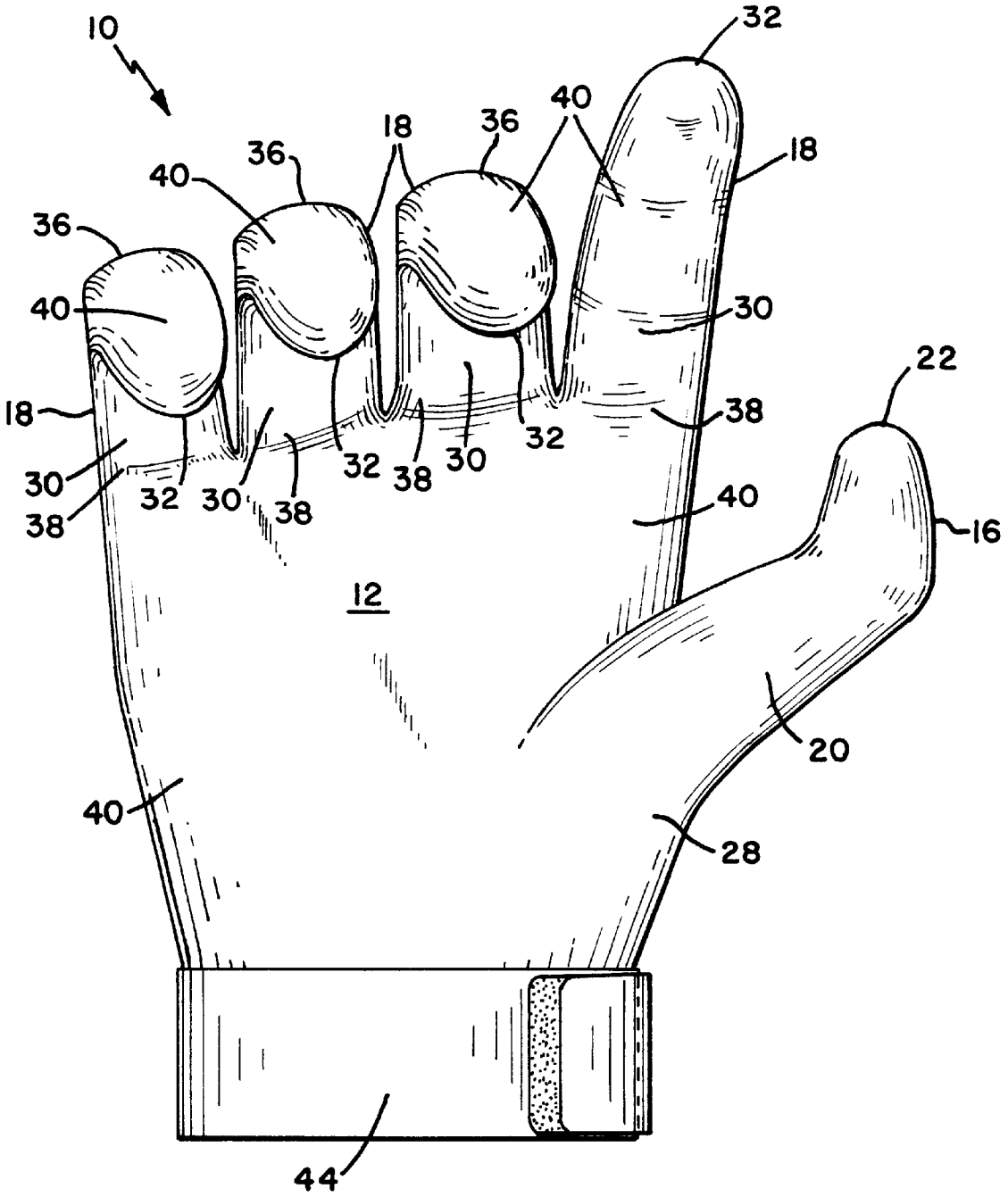
FIG. 3 is a front elevational view of the protective glove of FIG. 1.

In accordance with the present invention, protective glove 10 is comprised of molded, pliable plastic 40 and a cut resistant material 42. As used herein, the term "cut" is defined to include puncture, tear, rip, gash and abrasion. Referring to FIGS. 2 and 3, front side 12 of protective glove 10 is comprised of molded pliable plastic material 40 and a substantial portion of backside 14 of protective glove 10 is comprised of cut resistant material 42. In one embodiment, substantially all of thumb stall 16 is comprised of pliable plastic material 40 except for a portion of back side 24 which is comprised of cut resistant material 42. In such an embodiment, thumb stall 16 is configured such that cut resistant material 42 extends beyond base portion 28 to an area of back side 24 that is just below knuckle portion 26 with the remainder of back side 24 being comprised of plastic pliable material. In one embodiment, each finger stall 18 is comprised of pliable plastic material 40 except for a portion of back side 34 which is comprised of cut and liquid resistant material 42. In such an embodiment, the portion of back side 34 that extends from tip portion 32 to knuckle portion 36 is comprised of pliable, plastic material 40 and the remaining portion of back side 34 is comprised of cut resistant material 42.

Although protective glove 10 has been described in the foregoing description as having particular portions thereof being comprised of either pliable, plastic material 40 or cut resistant material 42, it is to be understood that other configurations are possible. For example, substantially all of thumb stall 18 and finger stalls 18 can be comprised of pliable, plastic material 40. In another example, all of back sides 24 and 34 of thumb stalls 16 and finger stalls 18, respectively, are comprised of cut resistant material 42. Still, other configurations are possible. In another embodiment, cut resistant material 42 is also configured to be liquid resistant. Such an embodiment is discussed in detail in the ensuing description.

Referring to FIG. 2, cut resistant material 42 includes a folded dart or pleat 46 to allow a wearer to quickly don and doff protective glove 10.

Referring to FIG. 1, molded, pliable plastic material 40 is molded to conform to a three-dimensional, anthropomorphic hand that is in a relaxed position. Thus, protective glove 10 has a curved shape and finger stalls 18 are bent. The shape of protective glove 10 substantially reduces the amount of effort required to flex the hand while working with cables, barbed wire, concertina wire, razor wire, etc. In a preferred embodiment, molded, pliable plastic 40 is seamless. Molded, pliable plastic 40 can be configured from any one of a variety of plastics, e.g. polyethylene, low density polyethylene ("LDPE"), polypropylene, copolymer polypropylene, and polyvinyl chloride ("PVC"). Other types of suitable plastics can also be used, e.g. LEXAN® polythylene plastic-faced sheeting. In one embodiment, molded, pliable plastic 40 has a thickness between about 1/32 inch and 1/8 inch. However, it is to be understood that molded, pliable plastic 40 can have a thickness that is less than 1/32 inch or greater than 1/8 inch.

Referring to FIG. 2, cut resistant material 42 is comprised of an interior layer of material that absorbs the impact of a blunt force and is resistant to penetration by the sharp edges or barbs of barbed, concertina or razor wire. The interior layer is in contact with the wearer's hand. In one embodiment, interior layer is fabricated from a needle-punched non-woven material, e.g. needle-punched polyester.

Referring to FIG. 2, cut resistant material 42 further comprises an exterior layer that is attached to and protects the interior layer. In one embodiment, the exterior layer is laminated to the interior layer. In a preferred embodiment, the exterior layer is also cut resistant. The exterior layer can be fabricated from several suitable materials. For example, the exterior layer can be fabricated from KEVLAR™ armid fabric or a mono-filament woven material. In another embodiment, the exterior layer of cut resistant material 42 is configured to be liquid resistant. This can be accomplished in several ways. For example, the exterior layer can be fabricated from a silicone-coated polyester sail cloth. In another example, the exterior layer is fabricated from KEVLAR™ armid fabric that has been treated to provide resistance to liquids or moisture. In a further example, the exterior layer is fabricated from a mono-filament woven material that has been treated to provide resistance to liquids or moisture.

In a preferred embodiment, cut resistant material 42 is comprised of a breathable material that permits air circulation within the interior of glove 10.

In a preferred embodiment, molded, pliable plastic material 40 is attached to cut resistant material 42 without the use of stitching. For example, molded, pliable plastic 40 can be attached to cut resistant material 42 by adhesive bonding, ultrasonic bonding, radio-frequency bonding or seam taping. If adhesive bonding is used, it is preferred that cut resistant material 42 is bonded to the plastic material when the plastic is in a plasticized state.

Referring to FIGS. 1, 2 and 3, molded, pliable plastic material 40 and cut resistant material 42 are configured to extend over the wrist area of the wearer's hand. In one embodiment, protective glove 10 further comprises fastener 44 attached back side 14 for allowing an adjustable fit of protective glove 10 and for preventing liquids from seeping into the interior of protective glove 10. In one embodiment, fastener 44 comprises a wrist strap that is bonded to cut resistant material 42. In another embodiment, the wrist strap fastener 44 is stitched and sealed to cut resistant material 42. In one embodiment, fastener 44 comprises a VELCRO™-type hook and loop fastener. In such a configuration, a VELCRO™ hook and loop fastener loop and a VELCRO™ hook and loop-fastener backing strip are attached to the portion of cut resistant material 42 that adjacent the wrist portion of protective glove 10. The VELCRO™ loop is then wrapped around front side 12 and removably fastened to the VELCRO™ hook and hoop fasteners backing strip. However, it is to be understood that other type fasteners can be used, e.g. buckles, snaps, elastic bands, etc.

Protective glove 10 of the present invention provides protection for the full hand against severe punctures, cuts and abrasions from barbed wire, concertina wire and razor wire and yet, is relatively light in weight and less bulky than conventional prior art protection gloves. The exterior surfaces of molded pliable, plastic material 40 and cut resistant material 42 also reduce the probability of glove 10 becoming snagged upon sharp objects. Molded, pliable, plastic material 40 is molded to provide glove 10 with a relaxed-hand shape thereby providing a comfortable fit to the wearer's hand and substantially reducing hand fatigue as well as debilitating muscle disorders such as carpal tunnel syndrome. Furthermore, protective glove 10 does not use any stitching in the finger stalls thereby providing comfort and facilitating finger dexterity. Additionally, protective glove 10 can be worn over cold-weather glove liners as well as the rubber gloves used to prevent electrical shock.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention, what is claimed is:

1. A protective glove, comprising:

a first portion for covering the palm-side of a wearer's hand, the first portion being comprised of a piece of pliable plastic material molded in a three-dimensional shape that conforms to the shape of a hand in a relaxed position;

a second portion attached to the first portion, the second portion covering the back side of the wearer's hand, the second portion being comprised of a cut resistant material;

a thumb stall having a first side corresponding to the palm side of the wearer's hand, and a second side corresponding to the backside of the wearer's hand, the thumb stall being comprised of the molded pliable plastic material except for a portion of the second side of the thumb stall, said portion of the second side of the thumb stall being comprised of the cut resistant material; and wherein the thumb stall includes a tip portion and knuckle region, the area between the tip portion and knuckle portion defining the portion of the second side of the thumb stall that is comprised of the pliable plastic material.

2. The protective glove according to claim 1 wherein the cut resistant material, comprising the second portion covering the back side of the wearer's hand, has a folded dart formed therein.

3. The protective glove according to claim 1 wherein the molded, pliable plastic material and the cut resistant material define a wrist covering portion for covering the wrist of the wearer's hand.

4. The protective glove according to claim 3 further including means attached to the glove for tightening the protective glove about the wrist of the wearer.

5. The protective glove according to claim 4 wherein the tightening means comprises a hook and loop fastener.

6. The protective glove according to claim 1 wherein the piece of plastic comprises a single, seamless piece of plastic.

7. The protective glove according to claim 1 wherein the molded, pliable plastic material is comprised of a low density polyethylene.

8. A protective glove, comprising:

a first portion for covering the palm-side of a wearer's hand, the first portion being comprised of a piece of pliable plastic material molded in a three-dimensional shape that conforms to the shape of a hand in a relaxed position;

a second portion attached to the first portion, the second portion covering the back side of the wearer's hand, the second portion being comprised of a cut resistant material;

a plurality of finger stalls, each finger stall having a first side corresponding to the palm side of the wearer's hand, and a second side corresponding to the backside of the wearer's hand, the finger stall being comprised of the molded, pliable plastic material except for a portion of the second side of the finger stall, said portion of the second side of the finger stall being comprised of the cut resistant material; and wherein each finger stall includes a tip portion and knuckle region, the area between the tip portion and knuckle portion defining said portion of the second side of the finger stall that is comprised of the molded, pliable plastic material.

9. A protective glove, comprising:

a first portion for covering the palm-side of a wearer's hand, the first portion being comprised of a piece of pliable plastic material molded in a three-dimensional shape that conforms to the shape of a hand in a relaxed position;

a second portion attached to the first portion, the second portion covering the back side of the wearer's hand, the second portion being comprised of a cut resistant material; and wherein the cut resistant material comprises an interior layer of material configured for absorbing the impact of a blunt forces and resisting cuts.

10. The protective glove according to claim 9 wherein the interior layer is fabricated from a needle-punched non-woven material.

11. The protective glove according to claim 9 wherein the cut resistant material comprises an exterior layer that is attached to the interior layer.

12. The protective glove according to claim 11 wherein the exterior layer is comprised of a mono-filament woven material.

13. The protective glove according to claim 11 wherein the exterior layer is comprised of para-aramid fibers.

14. The protective glove according to claim 11 wherein the exterior layer is liquid-resistant.

15. The protective glove according to claim 14 wherein the exterior layer is comprised of silicone-coated polyester sailcloth.

16. The protective glove according to claim 11 wherein the exterior layer is laminated to the interior layer.

* * * * *